US007956596B2

(12) United States Patent
Larsson

(10) Patent No.: US 7,956,596 B2
(45) Date of Patent: Jun. 7, 2011

(54) VOLTAGE CONTROL FOR ELECTRIC POWER SYSTEMS

(75) Inventor: Mats Larsson, Baden-Däwil (CH)

(73) Assignee: ABB Research Ltd, Zurich (CH)

( * ) Notice: Subject to any disclaimer, the term of this patent is extended or adjusted under 35 U.S.C. 154(b) by 0 days.

(21) Appl. No.: 12/762,145

(22) Filed: Apr. 16, 2010

(65) Prior Publication Data

US 2010/0264897 A1 Oct. 21, 2010

Related U.S. Application Data

(60) Division of application No. 12/465,470, filed on May 13, 2009, now abandoned, which is a continuation of application No. PCT/EP2007/062007, filed on Nov. 7, 2007.

(30) Foreign Application Priority Data

Nov. 17, 2006 (EP) ..... 06405486

(51) Int. Cl.
*G05F 3/04* (2006.01)
*G05F 1/34* (2006.01)

(52) U.S. Cl. ..... 323/301; 323/255

(58) Field of Classification Search ..... 323/247, 323/255–258, 299, 301; 702/57, 60, 64; 307/102, 104

See application file for complete search history.

(56) References Cited

U.S. PATENT DOCUMENTS

| | | | | |
|---|---|---|---|---|
| 5,272,462 | A * | 12/1993 | Teyssandier et al. | 340/310.11 |
| 5,646,512 | A | 7/1997 | Beckwith | |
| 7,069,159 | B2 * | 6/2006 | Zima et al. | 702/57 |
| 2009/0079267 | A1 * | 3/2009 | Korba et al. | 307/102 |

FOREIGN PATENT DOCUMENTS

| | | |
|---|---|---|
| EP | 1 923 765 A1 | 5/2008 |
| WO | WO 96/23250 A1 | 8/1996 |

OTHER PUBLICATIONS

Form PCT/ISA/210 (International Search Report) dated Mar. 18, 2008.

Form PCT/ISA/237 (Written Opinion of the International Searching Authority) dated Mar. 18, 2008.

(Continued)

*Primary Examiner* — Matthew V Nguyen

(74) *Attorney, Agent, or Firm* — Buchanan Ingersoll & Rooney PC

(57) ABSTRACT

A limitation of the interaction between cascaded tap changers and/or between a tap changer and a shunt compensator independently of any real-time communication between the respective controllers is disclosed. Coordinated voltage control in distribution networks can be achieved by an adaptive updating or tuning of control parameters $DB_4$, $TD_4$ of a voltage control unit controlling a second voltage control device, depending on instantaneous or actual operating conditions evaluated by the voltage control unit itself. Instead of using constant control parameters initially set by a commissioning engineer, the parameters are updated based on a voltage level $U^P_4$, which in turn is responsive to or affected by any control action performed by a first voltage control device neighboring the second voltage control device. The voltage control unit calculates a deviation of an instantaneous value of the voltage level from a reference value, and translates or maps this deviation to an update of its dead bands and/or time delay characteristics. Hence, the voltage control unit can anticipate, or determine a likelihood of, a control action of the first voltage control device, without the need for a real-time transmission of this information to the voltage control unit.

8 Claims, 3 Drawing Sheets

OTHER PUBLICATIONS

Form PCT/IPEA/409 (International Preliminary Report on Patentability) dated Feb. 6, 2009.
European Search Report dated May 18, 2007.
Mats Larsson, "Coordination of Cascaded Tap Changers Using a Fuzzy-Rule-Based Controller", *Fuzzy Sets and Systems*, Feb. 16, 1999, vol. 102, No. 1, pp. 113-123, XP-004153045.
Yan-Jun Li et al., "Optimal Coordinated Voltage Control of Power Systems", *Journal of Zhejiang University Science A*, An International Applied Physics & Engineering Journal, Feb. 1, 2006. vol. 7, No. 2, pp. 257-262, XP-019360963.
C. Taylor, "Power System Voltage Stability", ISBN 0-07-063184-0, McGraw-Hill, 1994, Chapter 7.5, pp. 174-179.
Mats Larsson, "Coordination of Cascaded Tap Changers Using a Fuzzy-Rule Based Controller", *Dept. of Industrial Electrical Engineering and Automation*, Lund Institute of Technology, Oct. 13, 2004, 25 pages.

* cited by examiner

Fig. 1
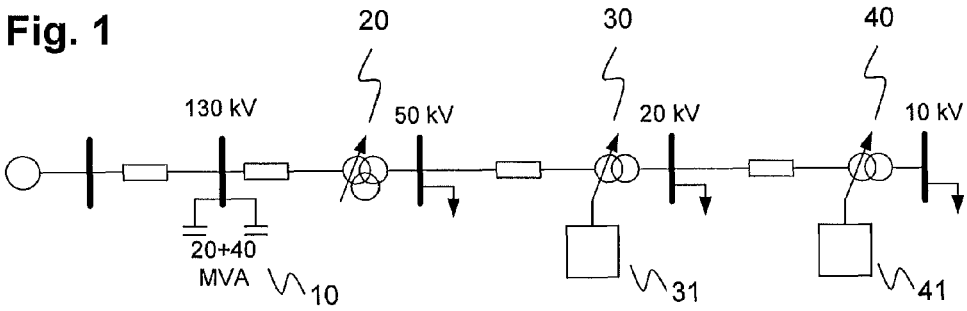
Fig. 2
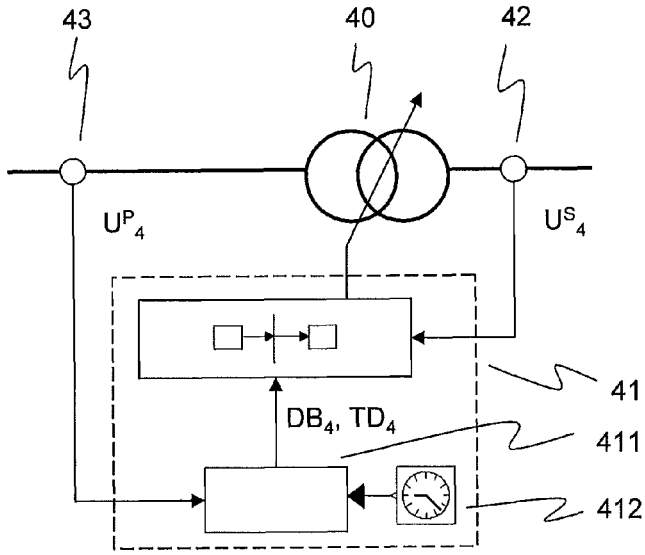
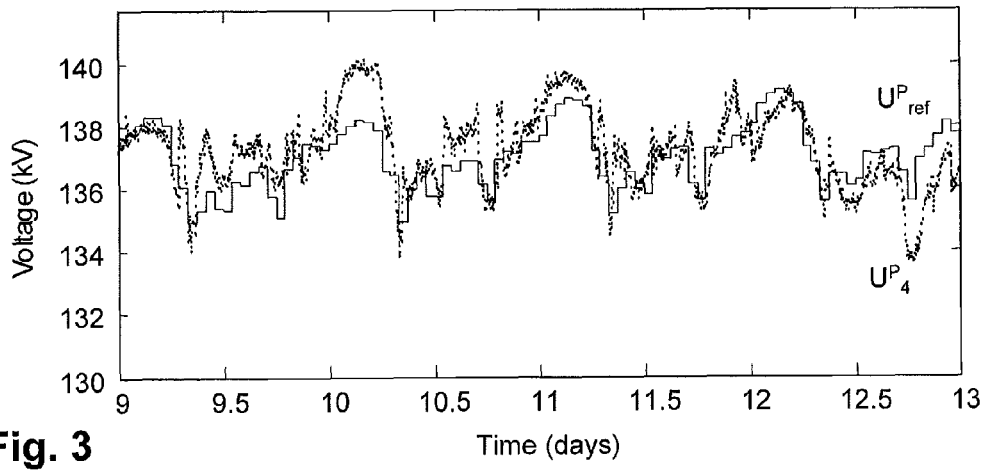
Fig. 3

VOLTAGE CONTROL FOR ELECTRIC POWER SYSTEMS

RELATED APPLICATIONS

The present application is a divisional of application Ser. No. 12/465,470 filed May 13, 2009, which is a continuation application under 35 U.S.C. §120 to PCT/EP2007/062007, which was filed as an International Application on Nov. 7, 2007 designating the U.S., and which claims priority to European Application 06405486.9 filed in Europe on Nov. 17, 2006. The entire contents of these applications are hereby incorporated by reference in their entireties.

FIELD

The disclosure relates to the field of voltage control in electric power systems.

BACKGROUND INFORMATION

Known distribution networks or grids have a radial structure with loop-free paths from any point of low to any point of high voltage, and relay power from a feeding transmission network to loads distributed over the entire distribution area. Voltage control is used to ensure that each load receives the right level of voltage and as stable a voltage as possible. In distribution networks, a primary means of voltage regulation are tap changers. Tap changers act by adjusting the turns-ratio between the primary and secondary windings of a tap changing transformer, and can thus regulate the voltage on the secondary side. Another known means for voltage control are compensator controllers for shunt compensators such as capacitors and shunt reactors, which act by injecting reactive power and thereby indirectly also affect the voltage.

A tap changer can be equipped with an automatic tap changer controller that aims at keeping the measured voltage on the secondary side of the transformer within a predetermined interval referred to as the dead band. As soon as a voltage deviation from this interval is detected, a counter is started that stops when the deviation has passed or, if the deviation persists, initiates a tap change when a maximum time limit, referred to as the delay time, has been reached. If a tap change is indeed initiated, a slight mechanical time delay of a few seconds can be taken into account, corresponding to the time it takes for the tap changer to actually react and switch. The discrete-valued tap control can span +/−10 percent taken in 10-20 steps of 1-2 percent each in Europe or in 32 steps of 0.625 percent each in the United States.

Known capacitors and shunt reactors are switched on a daily basis, either manually or by compensator controllers similar to the tap changer controllers but based on a feeder/bus voltage or other system quantities such as temperature or reactive power flow.

Serially connected or cascaded tap changers situated along a radial feeder are not independent, as upstream or higher voltage tap changers can strongly influence downstream or lower voltage ones. Known voltage profile indicators of such interaction are so called spikes, brief voltage excursions arising when the upstream and the downstream tap changers react to the same voltage disturbance by the same action—the accumulated effect downstream can then be too large and the downstream tap changer will have to reverse its action.

Known systems comprise simple schemes based on differentiated time delays. They use information about the location of the tap changer in the network and assign longer time delays to downstream tap changers so that the latter can await the reactions of the upstream ones. On the other hand, tap changing actions can be made conditional on the intended action of the tap changer situated immediately upstream. These approaches can only provide tap changer coordination in the event of changes in the feeding transmission voltage. For changes due to variations in the load, occurring with time constants that are very long compared to the time delays, these methods cannot provide coordination unless additional communication between the tap changers is provided. In addition, as shunt capacitors may give rise to much larger voltage changes than tap changing transformers, causing a transient response from all the tap changers, interactions between tap changers and capacitors or shunt reactors at one and the same substation may also warrant coordination.

The textbook by C. Taylor entitled "Power system voltage stability", ISBN 0-07-063184-0, McGraw-Hill, 1994, Chapter 7.5 (pages 174 to 179), discloses a centralized automatic control of mechanically switched capacitors. This document, and all documents mentioned herein, are incorporated by reference in their entireties. A possible substation controller characteristic for a substation with both 500 kV and 230 kV capacitor banks and a 500/120-kV Load Tap Changer autotransformer is disclosed. In a two dimensional representation, rectangular intersections of two dead bands in terms of primary and secondary transformer voltage define a total of nine areas associated with switching orders for the capacitors or the transformer. The dead band limits can be rigid, and the fact that in some of the areas, tap changer operations are supplanted by capacitor switching orders is equivalent to a semi-infinite dead band for the tap changer.

In U.S. Pat. No. 5,646,512, cooperative or combined control of tap changers and capacitors is proposed as a distributed solution where voltage, power factor and reactive power dead bands are allowed to be variable rather than fixed. At the same time, tap changers and substation capacitors react to different signals—voltage and reactive power, respectively—whereas pole-top capacitors base their adaptive capacitor control on local voltage. By opting for different key signals for tap changers and substation capacitors, the risk of controller interference can be reduced since the substation capacitors will then be less sensitive to the small voltage fluctuations induced by tap changer actions. Finally, tap changer time delays are adapted in such a way as to make the delays shorter for greater voltage deviations. The dead band width can be symmetrically adapted, i.e., broadened or narrowed, over a time scale of weeks in order to limit the number of actions to an acceptable level of, e.g., 20 per day, thus implicitly ignoring the least important ones.

Compared to the above, coordination on a shorter time scale is proposed in the article by M. Larsson entitled "Coordination of cascaded tap changers using a fuzzy-rule based controller", Fuzzy Sets and Systems, Vol. 102, No. 1, pp. 113-123, 1999. Fuzzy sets indicating a first tap changer's tendency to switch in either direction are transmitted via appropriate inter-substation communication channels to a second tap changer. A lower level tap changer uses this remote information in the determination of its own fuzzy sets, accelerating or decelerating its own actions depending on the switching tendency of a higher level tap changer.

SUMMARY

A method is disclosed of coordinated voltage control using voltage control devices serially connected between a transmission substation and a load, comprising: controlling a local voltage level ($U^S_3$, $U^S_4$) in response to control commands issued to each device by a respective first and second voltage control unit and based on control parameters which are dead band ($DB_3$, $DB_4$) and time-delay ($TD_3$ $ID_4$) characteristics; measuring an instantaneous value of a voltage level ($U^P_4$) at a location in-between a first and a second voltage control device; issuing, by the second voltage control unit, control commands for the second voltage control device; calculating a deviation of the measured instantaneous value of the voltage level ($U^P_4$) from a voltage level reference value ($U^P_{ref}$); and updating values of the control parameters ($DB_4$, $TD_4$) of the second voltage control unit based on said deviation.

A control parameter is disclosed tuning unit for updating values of control parameters, which are dead band ($DB_4$) and time delay ($TD_4$) characteristics of a voltage control unit used to control a voltage control device serially connected between a transmission substation and a load, the control parameter tuning unit comprising: means for receiving an input of a measured instantaneous value of a voltage level ($U^S_3$, $U^P_4$) controlled by a neighboring voltage control unit; and means for determining a deviation of the measured instantaneous value of the voltage level ($U^S_3$, $U^P_4$) from a voltage level reference value ($U^P_{ref}$).

BRIEF DESCRIPTION OF THE DRAWINGS

The subject matter of the disclosure will be explained in more detail in the following text with reference to exemplary embodiments which are illustrated in the attached drawings, in which:

FIG. 1 schematically shows an exemplary radial distribution network structure;

FIG. 2 is a functional overview of an exemplary adaptive tap changer controller;

FIG. 3 depicts exemplary expected and actual voltage profiles;

The reference symbols used in the drawings, and their meanings, are listed in summary form in the list of reference symbols. In principle, identical parts are provided with the same reference symbols in the figures.

DETAILED DESCRIPTION

Figure 4:
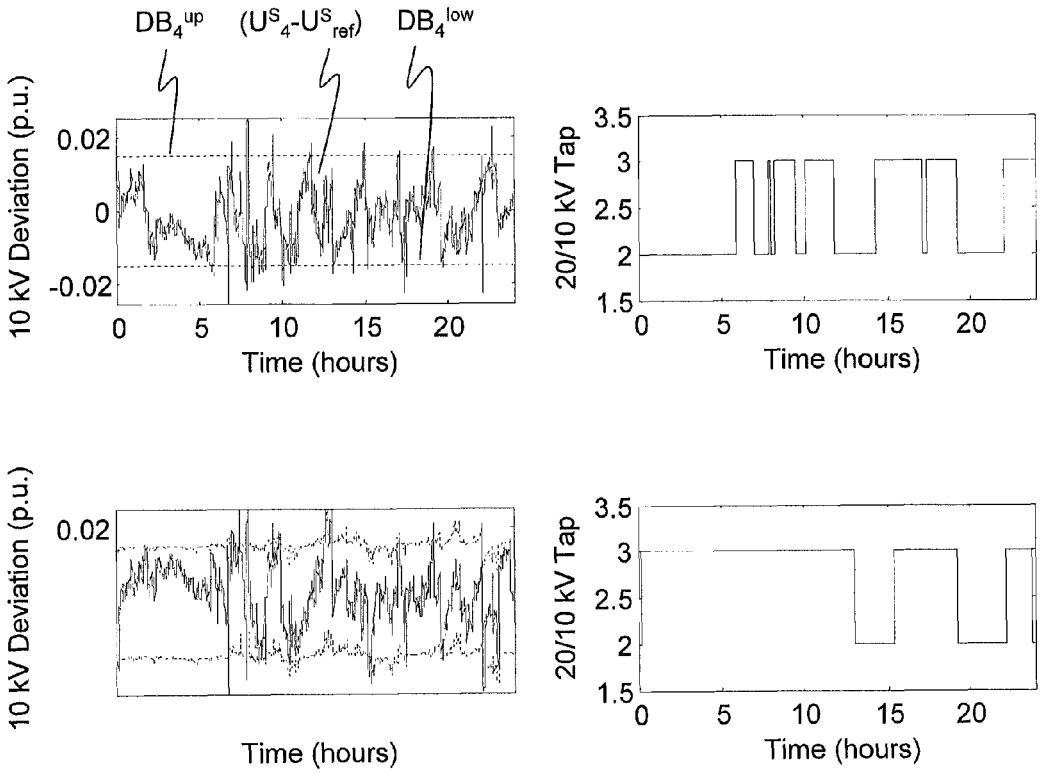
FIG. 4 shows an exemplary simulated daily operation of an exemplary cascaded tap changing transformer.

Exemplary embodiments disclosed herein can limit the interaction between cascaded tap changers and/or between a tap changer and a shunt compensator independently of any real-time communication between the respective controllers. A method of coordinated voltage control is disclosed, and a control parameter tuning unit is disclosed.

According to the disclosure, coordinated voltage control in distribution networks can be achieved by an adaptive updating or tuning of control parameters of a voltage control unit, such as a tap changer controller or a compensator controller controlling a second voltage control device, depending on instantaneous or actual operating conditions evaluated by the voltage control unit itself. Instead of using constant control parameters initially set by a commissioning engineer, control parameters are updated based on a voltage level, which in turn is responsive to or affected by any control action performed by a first voltage control device neighboring the second voltage control device, by way of inputting values of the voltage level to the voltage control unit. In the case of a tap changer controller, the voltage level can be a primary side voltage of a tap changing transformer as the second voltage control device. The voltage control unit can calculate a deviation of an instantaneous value of the voltage level from a reference value, and translates or maps this deviation to an update of its dead bands and/or time delay characteristics. Hence, the voltage control unit can inherently anticipate, or determine a likelihood of, a control action of the first voltage control device, without the need for a real-time transmission of this piece of information to the voltage control unit. This ultimately results in a reduced number of control actions to be executed by the second voltage control device while, at the same time, relaxing the requirements on the inter-controller communication.

In a first exemplary variant, the voltage level as a locally available system quantity is repeatedly measured by means of a voltage level sensor connected to the voltage control unit. A time-stamped series of the measured historical values is generated, and a reference or expectation curve over a typical load cycle of, e.g., 24 hours is derived therefrom. The expectation curve is then used, together with the instantaneous value of the voltage level, for a continuous adaptation of the control parameters. In this variant, the use of a remote signal connection to a neighboring voltage control unit can be completely avoided, as historical and instantaneous values of the voltage level together provide for sufficiently accurate information about the behavior of an upstream voltage control device to the downstream controller.

In a second exemplary embodiment, dead band adaptation at a second controller is based on a communication of the actual or presently valid control parameters of a neighboring first controller. That is, if multiple controllers are located in the same substation or if communication channels between the substations where the controllers are located are available for a communication of this type of information, there is no need to revert to expectation curves. Due to the fact that similar or even identical control parameter and voltage level values are available to the downstream controller, quite accurate information about the behavior of an upstream voltage control device can be reconstructed by the former. For example, two neighboring controllers reciprocally communicate their respective actual control parameter values in order to accelerate switching actions by a first one and decelerate switching actions by a second one of the two corresponding voltage control devices.

In an exemplary embodiment of the disclosure, a slow adaptation stage is introduced where the average number of tap operations and average voltage deviations over several days are observed. The base dead band mean value and width can be adjusted to provide a desired balance between the number of operations and the voltage deviations. The slow adaptation is to simplify tuning, and avoid excessive stepping of the tap changer when poorly tuned or unexpected operating conditions occur by introducing a trade-off between the average voltage deviations and the average number of tap changer operations.

FIG. 1 shows an excerpt of an exemplary structure of a distribution network. Along a radial feeder originating at a transmission substation and ending at a load, a succession of decreasing voltage levels is indicated. At the highest voltage level depicted (130 kV), which is also representing the lowest voltage level in the transmission system and known as the sub-transmission level, a shunt capacitor bank 10 is depicted as a first voltage control device. Three tap changing transformers 20, 30, 40 are provided as further voltage control devices connecting successive voltage levels. Between a lower and a higher voltage level, one singular current path is possible, and no loops are being formed. Any of the voltage control devices 10, 20, 30, 40 shown may be used to control, in response to control commands issued by appropriate voltage control units 31, 41, at least the downstream voltage, i.e., the voltage level at the far side from the substation.

FIG. 2 shows a structure of an exemplary voltage control unit 41 according to the disclosure, including its interfaces to a tap changing transformer 40 as the voltage control device that is part of the primary equipment of the distribution network. The voltage control unit 41 depicted is a tap controller with a Finite-State Machine (FSM) that manipulates the transformer 40 via increase/decrease activation pulses. The FSM logic uses a time-delay $TD_4$ and a dead band $DB_4$ and is substantially the same as the one used in known tap changer control systems. A voltage level identical to the secondary voltage $U^S_4$ of the transformer 40 is to be regulated, and to this purpose its momentary or actual value $U^S_4$ is sensed by means of voltage transformer 42, fed to the voltage control unit 41 and compared to the dead bands $DB_4$.

Furthermore, a primary voltage $U^P_4$ of the transformer 40 is measured by means of a voltage level sensor 43 that is connected to the voltage control unit 41, and more particularly to an A/D conversion stage thereof. This primary voltage $U^P_4$ is a control quantity substantially identical to the voltage level $U^S_3$ to be regulated by a neighboring voltage control unit 31 of a voltage control device 30 located upstream of the transformer 40. An instantaneous value $U^P_4$ of this primary voltage, i.e., a signal indicative of the remotely located neighboring voltage control unit 31, measured by sensing device 43 close to the location of the transformer 40, is input to a control parameter tuning unit 411. The latter is equipped with a timer or clock 412 and evaluates the measured value $U^P_4$ to generate control parameter updates $DB_4$, $TD_4$ on behalf of the voltage control unit 41.

In particular, repeatedly measured values $\{U^P_4\}$ of the primary voltage $U^P_4$ are input to the control parameter tuning unit 411, and the time-stamped data thus collected is consolidated into an expectation or reference curve $U^P_{ref}$ to be evaluated together with the instantaneous value $U^P_4$. To this end, the control parameter tuning unit 411 assumes the load variations and resulting voltage variations to be periodic with a base cycle of 24 hours, wherein working days and week ends may have to be distinguished. In a first stage of the adaptive procedure, the tuning unit identifies these base cycles and generates the expectation curve with an expected or standard profile over the 24 hour base period. FIG. 3 depicts an exemplary expectation curve $U^P_{ref}$ including (e.g., consisting of) a succession of hourly averages (continuous line), as well as an actual curve $U^P_4$ including (e.g., consisting of) exemplary measured instantaneous values of the same system quantity (dotted line). The expectation curve $U^P_{ref}$ itself may be adaptively updated in an iterative learning procedure in order to adequately approximate the momentary behavior of the power system at any time.

By way of example, such an iterative learning procedure can be accomplished through an arrangement of nested low pass filters or mean value calculations. Firstly, the system quantity is sampled and the measured values are stored in a short term buffer during a fraction of the base period, e.g., during one hour. At the end of this hour, a momentary mean value is calculated, and a weighted average of the latter and a previously stored long-term mean value is calculated and stored as an updated long-term mean value for the particular hour of the day under consideration. The succession of these hourly mean values builds up the expectation curve $U^P_{ref}$ in FIG. 3. By adjusting the weights in the weighted average computation, the desired learning speed can be obtained. Experience shows that a learning period of, for example, one to two weeks is sufficient for learning the weekly voltage and load variations and identifying the behavior of remote shunt switching and time-based voltage set points.

In a fast adaptation stage, the dead bands $DB_4$ of the voltage control unit 41 are adjusted based on the expectation curve $U^P_{ref}$ as previously determined and the instantaneous measurement $U^P_4(t^*)$ of the system quantity that is being approximated by the expectation curve. In particular, and as illustrated in the example below, the expectation curve can be translated, for each hour or minute of the day, into a variation of the controller's upper dead band $DB_4^{up}$ and/or lower dead band $DB_4^{low}$, to an extent proportional to a deviation of the measured instantaneous value $U^P_4(t^*)$ from the particular value of the expectation curve $U^P_{ref}$ at the respective moment t*. Fuzzy logic provides a convenient way for this type of translating or mapping heuristic knowledge into mathematical functions. Examples of the heuristic motivation behind this adaptation are to delay tap operations of the transformer 40 when an upstream voltage control device 30 is likely to compensate for an observed voltage deviation to avoid interaction. For example if the primary side voltage level at transformer 40 is lower than what the expectation curve suggests it should be, a corrective action can be expected by a voltage control unit of the devices 10, 20, at a higher level, and it can therefore be desirable to delay upwards operations by the transformer 40. Such delay can, for example, be accomplished by increasing the lower dead-band of the controller for transformer 40 and by increasing the time delay.

FIG. 4 illustrates the validity and benefit of the proposed procedure applied to the tap changing transformer 40 at the 20/10 kV connection in FIG. 1. The two top diagrams depict a known case with a fixed upper and lower dead band $DB_4^{up}$, $DB_4^{low}$ and the deviation of the secondary side voltage $U^S_4$ from a reference value $U^S_{ref}$ (left hand diagram, denoted 10 kV deviation), leading to frequent tap changing actions (right hand diagram). It is to be noted that due to the non-zero time delay $TD_4$, short excursions of the deviation beyond the dead band do not lead to tap changes. In the bottom line, the adaptation of the dead bands is based on the deviation of the primary side voltage $U^P_4$ of the transformer 40 from an expectation curve $U^P_{ref}$ of this quantity as detailed above. This case enables the downstream transformer 40 to anticipate the tap changing actions of the upstream transformer 30, and accordingly considerably reduces the number of tap changing actions performed by the downstream transformer 40 (right hand diagram) as compared to the first, static case.

Instead of identifying the behavior of a remotely located voltage control device, i.e., in the exemplary case of a shunt capacitor 10 and a tap changing transformer 20 being located in the same substation, the dead-bands in the compensator controller of shunt capacitor 10 and the tap changer controller of transformer 20 can be adjusted without the need of building up expectation curves. In this case, the dead-bands and time delays of the capacitor and tap changer controller can be adapted using direct exchange of control parameter values via intra-substation communication means such as a substation communication bus if the two controllers are implemented in different physical devices. As an example, the logic used to adapt the capacitor controller dead bands can accelerate capacitor switching when the tap changer controller is about to act and to delay tap change operations when the capacitor is about to act.

Figure 5:
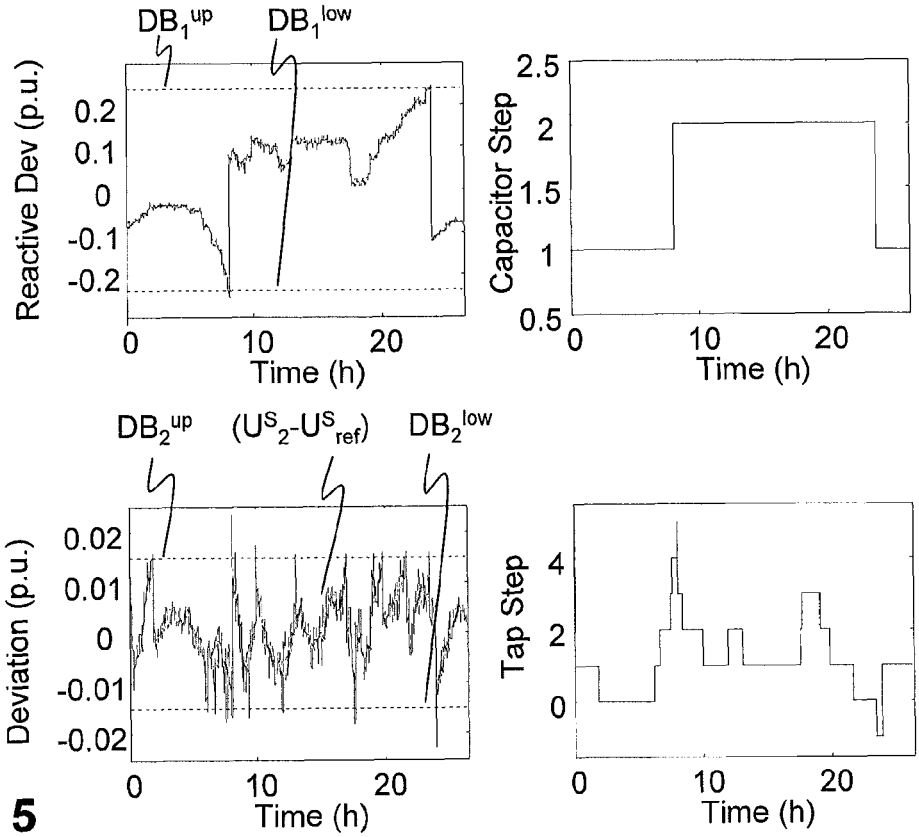
FIG. 5 shows an exemplary simulated daily operation of an exemplary coordinated capacitor and tap changing transformer using fixed dead bands.
Figure 6:
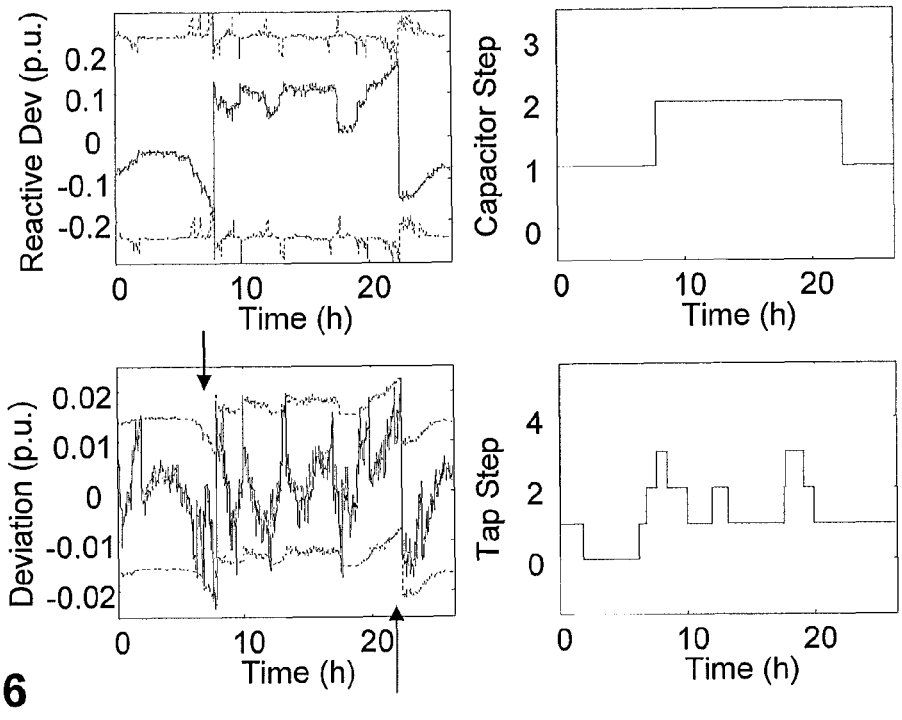
FIG. 6 shows an exemplary simulated daily operation using adaptive dead bands.

FIGS. 5 and 6 illustrate some advantages of an exemplary adaptive tap changer control according to the disclosure, compared to known control logic and applied to the case of a substation with both a capacitor 10 and a tap changing transformer 20 as depicted at the 130 kV voltage level in FIG. 1. In this case, the capacitor regulates the reactive load on the primary side of the transformer to minimize the reactive power flow. The tap changer controls the secondary side voltage $U^S_2$ of the transformer.

FIG. 5 shows, in the top left diagram, a simulation of a 24 hour cycle of a system quantity being the normalized reactive load deviation from a reference value of zero (corresponding to no reactive power load on the transformer). The capacitor's voltage control unit involves a constant dead band represented by the two horizontal lines $DB_1^{up}$, $DB_1^{low}$. At around 8.00 and 23.00, the load deviation exceeds the dead band, and capacitor steps are initiated (top right diagram). This produces a voltage spike propagating through all series connected transformers and can influence all tap changers situated along the radial feeder. The normalized transformer secondary side voltage deviation from a reference of 1 p.u. (denoted $U^S_2$-$U^S_{ref}$) is reported in the bottom left diagram. Due to the known non-adaptive tap control, the transformer's voltage control unit likewise involves a constant dead band $DB_2^{up}$, $DB_2^{low}$, which is exceeded by the secondary voltage deviation eighteen times within 24 hours, leading to frequent tap changes (bottom right diagram). There can be substantial interaction between the capacitor and tap changer controls, manifesting in spikes in the voltage deviations and unnecessary tap changes when the capacitor switches in at around 8.00 in the morning and when it is switched out at around 23 o'clock in the evening.

FIG. 6 shows simulation results of the same scenario with the proposed adaptive controllers. Both the upper and lower dead bands of the capacitor's voltage control unit (top left diagram) and the transformer's voltage control unit (bottom left diagram) are now adapted, based on a voltage level of the respective other voltage control device. For example, the capacitor's normalized reactive load deviation depicted in the top left diagram translates into the adapted dead bands of the transformer (bottom left diagram), whereas the normalized transformer secondary side voltage deviation depicted in the bottom left diagram is mapped to the adapted dead bands of the capacitor (top left diagram). The scaling, i.e., the translation or mapping of a deviation to the respective dead bands, is determined according to heuristic rules which in essence results in an exemplary use of the capacitor to regulate the voltage at the secondary side of the transformer. This can, for example, be achieved by accelerating the connection of the capacitor bank and decelerating tap changer operations when transformer secondary side voltage is low. The acceleration and deceleration can be achieved by adjusting the respective time delays or dead bands, or a combination thereof. It can be desirable to fix the maximum variation of the dead bands to, e.g., 20 or 40% of the nominal dead band width. Due to the exchange of actual or presently valid control parameter values between the control units of the coordinated control devices 10 and 20, the capacitor actions can be accelerated and the tap changing actions delayed. The coordinated capacitor steps in faster than before and the tap operations are delayed, thus avoiding the spikes (indicated by the two arrows in the bottom left diagram) and eliminating six out of eighteen unnecessary operations of the tap changer (bottom right diagram compared to FIG. 5). Thus, the adaptive control makes it possible to achieve better voltage quality with less control effort through coordination of the controllers.

Any of the voltage control units mentioned in the foregoing can be a controller for individual transformers and shunt compensators, i.e., a device voltage controller, or can be part of a controller that regulates one or more transformers and/or one or more shunt compensators in the same substation, i.e., a substation voltage controller. The functionality of the different controllers can be generally provided by software modules that may be at least partially implemented in the same physical device or piece of hardware.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF DESIGNATIONS

10 shunt capacitor
20, 30, 40 tap changing transformers
31, 41 voltage control unit
42 voltage transformer
43 voltage level sensor
411 control parameter tuning unit
412 clock

What is claimed is:

1. A method of coordinated voltage control using voltage control devices serially connected between a transmission substation and a load, comprising:

controlling a local voltage level ($U^S_3$, $U^S_4$) in response to control commands issued to a first and a second voltage control device by a respective first and second voltage control unit and based on control parameters which are dead band ($DB_3$, $DB_4$) and/or time-delay ($TD_3$ $ID_4$) characteristics;

measuring an instantaneous value of a voltage level ($U^P_4$) at a location in-between the first and the second voltage control device;

issuing, by the second voltage control unit, control commands for the second voltage control device;

calculating a deviation of the measured instantaneous value of the voltage level ($U^P_4$) from a voltage level reference value ($U^P_{ref}$); and updating values of the control parameters ($DB_4$, $TD_4$) of the second voltage control unit based on said deviation.

2. The method according to claim 1, comprising:

recording by the second voltage control unit a series of values ($\{U^P_4\}$) of the measured instantaneous value of the voltage level ($U^P_4$); and deriving from the series of values an expectation curve as the voltage level reference value ($U^P_{ref}$) representing a standard behavior of the instantaneous value of the voltage level ($U^P_4$).

3. The method according to claim 1, comprising:

communicating, by the first voltage control unit issuing control commands for of the first voltage control device, actual values of control parameters ($DB_3$, $TD_3$) to the second voltage control unit; and deriving, from the actual values of control parameters ($DB_3$, $TD_3$) communicated, by the second voltage control unit, the voltage level reference value ($U^P_{ref}$).

4. The method according to claim 3, comprising:

reciprocally updating control parameters which are dead-band ($DB_1$, $DB_2$) and time delay ($TD_1$, $TD_2$) characteristics of voltage control units of two further voltage control devices, to favor switching actions by a first one of the two further voltage control devices.

5. The method according to claim 1, comprising:

adapting values of the control parameters ($DB_4$, $TD_4$) of the second voltage control unit to limit a number of control actions executed by the second voltage control device within a predetermined time period.

6. A control parameter tuning unit for updating values of control parameters, which are dead band ($DB_4$) and/or time delay ($TD_4$) characteristics of a voltage control unit used to control a second voltage control device, the control parameter tuning unit comprising:

means for receiving an input of a measured instantaneous value of a voltage level ($U^S_3$, $U^P_4$) controlled by a neighboring voltage control unit via a first voltage control device connected in series with the second voltage control device between a transmission substation and a load;

means for determining a deviation of the measured instantaneous value of the voltage level ($U^S_3$ $U^P_4$) from a voltage level reference value ($U^P_{ref}$), and means for updating the control parameter values based on said deviation.

7. The control parameter tuning unit according to claim 6, comprising:

a clock which generates a time-stamped series of values ($\{U^P_4\}$) of the measured instantaneous value of the voltage level ($U^P_4$) for deriving there from an expectation curve as the voltage level reference value ($U^P_{ref}$) representing a standard behavior of the measured instantaneous value of the voltage level ($U^P_4$).

8. The method according to claim 4, comprising:

adapting values of the control parameters ($DB_4$, $TD_4$) of the second voltage control unit to limit a number of control actions executed by the second voltage control device within a predetermined time period.

* * * * *